US012653293B2

(12) United States Patent
Tarajano Noya et al.

(10) Patent No.: US 12,653,293 B2
(45) Date of Patent: Jun. 16, 2026

(54) COSMETIC PRODUCT SAMPLING SYSTEM

(71) Applicant: ELC MANAGEMENT LLC, Melville, NY (US)

(72) Inventors: Lemis Tarajano Noya, Miami, FL (US); Robyn Lynne Adams, Long Island City, NY (US); Gianluca Mattaroccia, Sunnyside, NY (US); Timothy Hugh Calvert, Brentwood, TN (US); Douglas John Melenkevitz, Boonton, NJ (US); Matthew J. Hong, Dix Hills, NY (US); David Edward Wilson, Plainview, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 547 days.

(21) Appl. No.: 17/345,303

(22) Filed: Jun. 11, 2021

(65) Prior Publication Data

US 2022/0395072 A1 Dec. 15, 2022

(51) Int. Cl.

| | |
|---|---|
| ***A45D 33/28*** | (2006.01) |
| ***A45D 40/22*** | (2006.01) |
| ***A45D 40/24*** | (2006.01) |

(52) U.S. Cl.

CPC ..... *A45D 33/28* (2013.01); *A45D 40/22* (2013.01); *A45D 40/24* (2013.01);

(Continued)

(58) Field of Classification Search

CPC .. A45D 40/0087; A45D 33/36; A45D 33/006; A45D 2200/1036; A45D 2200/1018; A45D 33/28; A61B 15/0051

See application file for complete search history.

(56) References Cited

U.S. PATENT DOCUMENTS

| | | | |
|---|---|---|---|
| 2,497,950 | A | 2/1950 | Lohr et al. |
| 2,588,611 | A | 3/1952 | Breen |

(Continued)

FOREIGN PATENT DOCUMENTS

| | | | |
|---|---|---|---|
| CN | 110891454 | A | 3/2020 |
| JP | S5830933 | U | 2/1983 |

(Continued)

OTHER PUBLICATIONS

Winky Lux, "Mini Lipstick Kit," (2021). Retrieved from Internet on Jun. 11, 2021: URL: https://www.winkylux.com/products/mini-lip-pill-kit.

(Continued)

*Primary Examiner* — Nicholas D Lucchesi
*Assistant Examiner* — Jennifer Gill
(74) *Attorney, Agent, or Firm* — MARSHALL, GERSTEIN & BORUN LLP

(57) ABSTRACT

A system for sample, trial, and/or full-sized products includes a container defining at least one cavity, a product disk, a cosmetic product, an applicator, and an applicator engaging mechanism operably coupled with the applicator. The product disk includes a first side, a second side, a body extending therebetween, and a disk engaging mechanism. At least a portion of the first side of the product disk is selectively positionable adjacent to the at least one cavity of the container. The cosmetic product is at least partially disposed on the first side of the product disk. The applicator has first end that includes an applicator retention region. At least a portion of the second side of the product disk is positionable adjacent to the applicator retention region. The product disk is removably coupled with the cavity of the container and the applicator coupling mechanism.

20 Claims, 8 Drawing Sheets

(52) U.S. Cl.
CPC ..... *A45D 2200/052* (2013.01); *A45D 2200/1018* (2013.01); *A45D 2200/1036* (2013.01)

(56) References Cited

U.S. PATENT DOCUMENTS

| | | | | |
|---|---|---|---|---|
| 6,016,916 | A | 1/2000 | Ortner | |
| 6,094,771 | A * | 8/2000 | Egolf | A47K 11/10 15/210.1 |
| 6,611,986 | B1 * | 9/2003 | Seals | A47K 11/10 15/210.1 |
| 6,997,321 | B2 | 2/2006 | Young | |
| 7,386,910 | B2 * | 6/2008 | Minkler | A47L 13/16 15/210.1 |
| 8,226,311 | B2 | 7/2012 | Cronin | |
| 9,220,332 | B1 | 12/2015 | DeVito | |
| 9,277,798 | B2 | 3/2016 | Moreau | |
| 9,974,377 | B2 | 5/2018 | Keller et al. | |
| 2003/0105425 | A1 * | 6/2003 | Pauchet | A45D 34/045 604/46 |
| 2004/0129296 | A1 * | 7/2004 | Treacy | A47K 11/10 15/210.1 |
| 2006/0123955 | A1 * | 6/2006 | Cho | B25G 3/18 81/177.2 |
| 2006/0243295 | A1 | 11/2006 | Petit | |
| 2007/0006412 | A1 * | 1/2007 | Soller | A47K 11/10 15/210.1 |
| 2008/0022472 | A1 | 1/2008 | Minkler et al. | |
| 2008/0087296 | A1 | 4/2008 | Gueret | |
| 2009/0241981 | A1 | 10/2009 | Dobler et al. | |
| 2009/0324318 | A1 | 12/2009 | Wilde et al. | |
| 2012/0067367 | A1 * | 3/2012 | Stewart | A61C 15/046 132/327 |
| 2012/0266910 | A1 | 10/2012 | Tarling et al. | |
| 2012/0282010 | A1 * | 11/2012 | Albers | A46B 11/0041 220/259.3 |
| 2013/0014338 | A1 * | 1/2013 | Park | A46B 5/0095 15/176.1 |
| 2013/0061867 | A1 | 3/2013 | Kim et al. | |
| 2013/0133678 | A1 | 5/2013 | Nakashima | |
| 2015/0262593 | A1 | 9/2015 | Sasaki et al. | |
| 2015/0282593 | A1 * | 10/2015 | Earl | A45D 40/26 401/88 |
| 2016/0120289 | A1 * | 5/2016 | Viscomi | A45D 33/006 132/317 |
| 2016/0174679 | A1 | 6/2016 | Gorostiza et al. | |
| 2016/0199162 | A1 | 7/2016 | Brilliant et al. | |
| 2017/0224088 | A1 | 8/2017 | Parekh | |
| 2019/0029398 | A1 | 1/2019 | Zhang | |
| 2019/0053606 | A1 * | 2/2019 | Thorpe | A61M 35/003 |
| 2019/0281952 | A1 | 9/2019 | Meranus | |
| 2020/0128939 | A1 | 4/2020 | Kim et al. | |
| 2022/0031045 | A1 | 2/2022 | Trochel | |
| 2022/0386758 | A1 | 12/2022 | Kobashi | |

FOREIGN PATENT DOCUMENTS

| | | | |
|---|---|---|---|
| JP | 59-136719 | U | 9/1984 |
| JP | S62111499 | U | 7/1987 |
| JP | 01-017615 | U | 1/1989 |
| KR | 200393364 | Y1 | 8/2005 |
| KR | 20200030928 | A | 3/2020 |
| WO | WO-2009/054918 | A1 | 4/2009 |
| WO | WO 2012141522 | * | 10/2012 |

OTHER PUBLICATIONS

International Application No. PCT/US2022/032919, International Search Report and Written Opinion, mailed Oct. 7, 2022.
International Application No. PCT/US2022/032920, International Search Report and Written Opinion, mailed Oct. 4, 2022.
International Application No. PCT/US2022/032921, International Search Report and Written Opinion, mailed Oct. 7, 2022.
Taiwan Patent Application No. 111121730, Office Action, issued on Mar. 14, 2023.
Taiwan Patent Application No. 111121731, Office Action, mailed Mar. 15, 2023.
Taiwan Patent Application No. 111121728, Office Action, mailed Mar. 13, 2023.
Japanese Patent Application No. 2023-575749, Notice of Reasons for Rejection, mailed Oct. 1, 2024.
European Patent Application No. 22821072.0, Extended European Search Report, dated Mar. 19, 2025.

* cited by examiner

Section A-A

Section B-B

Section C-C

Section D-D

COSMETIC PRODUCT SAMPLING SYSTEM

FIELD OF THE DISCLOSURE

The present disclosure generally relates to cosmetic, hair care, body care, and/or skincare products and, more particularly, to systems and approaches for sample, trial, and/or full-sized products.

BACKGROUND

Cosmetic and/or skincare products and applicators may have a number of different visual characteristics. For example, products such as lipstick may be provided in varying colors or shades, sheen levels (e.g., matte, satin, or sheer), and/or may have varying degrees of transfer resistance. Oftentimes, consumers may wish to test a number of different products prior to purchasing full-sized versions of the product. Existing sampling systems oftentimes includes excessive amounts of disposable packaging that may be costly to manufacture and/or may present environmental concerns. Current sampling and trial experiences may not mimic a full-sized product, and as such, may not provide a consumer with a similar experience as when using the full-sized product. More specifically, current sampling and trial experiences are provided in small sizes that may be difficult to hold and may present other ergonomic challenges. In the event a consumer has a variety of different samples each having discrete packaging, the user would need to carry the individual packages on their person, which may be confusing and present a barrier to trial.

Accordingly, there is a need for improved accessories having improved functionalities.

SUMMARY

Examples within the scope of the present disclosure are directed to a system for sample, trial, and/or full-sized products. Such a system may include a container defining at least one cavity, a product disk, a cosmetic product, an applicator, and an applicator engaging mechanism operably coupled with the applicator. The product disk includes a first side, a second side, a body extending therebetween, and a disk engaging mechanism. At least a portion of the first side of the product disk is selectively positionable adjacent to the at least one cavity of the container. The cosmetic product is at least partially disposed on the first side of the product disk. The applicator has first end that includes an applicator retention region. At least a portion of the second side of the product disk is positionable adjacent to the applicator retention region. The product disk is removably coupled with the cavity of the container and the applicator coupling mechanism.

In some examples, the disk engaging mechanism may include a protrusion extending beyond the second side of the product disk. Further, in some examples, the applicator engaging mechanism may include a grip member disposed within a cavity of the applicator. The grip member may grasp the protrusion of the disk engaging mechanism to selectively couple the product disk with the applicator. Further, in these and other examples, the grip member may include a plurality of arms constructed from a resilient material. The applicator engaging mechanism may further include an urging member that moves towards the first end of the applicator to urge the protrusion to release the product disk from the first end of the applicator.

In a variation of these embodiments, the container may also define an applicator cavity that retains at least a portion of the applicator. In some examples, the cosmetic and/or skincare product may be in the form of at least one of a lipstick, a foundation, a concealer, an eyeshadow, a bronzer, a brow, a solid serum, a solid SPF product, a skin care item, a solid face balm, a lip balm, an applicator heads, a brush, a solid blush, a solid contouring stick, an impregnated sponge or carrier, or a semi-solid skin care or cosmetic product.

In some approaches, the body of the product disk may define a visual indicator that allows identification of the cosmetic product when the product disk is positioned adjacent to the at least one cavity.

In some examples, the container may define a second cavity. The system may further include a second cosmetic product being at least partially disposed on a second product disk. The second cosmetic product may have a different visual characteristic than a visual characteristic of the cosmetic product.

In accordance with another aspect, a reusable product system includes an applicator, an applicator engaging mechanism operably coupled with the applicator, a product disk, and a cosmetic product. The applicator has a first end that includes an applicator retention region. The product disk has a first side, a second side, a body extending therebetween, and a disk engaging mechanism. At least a portion of the second side of the product disk is positionable adjacent to the applicator retention region. The cosmetic product is at least partially disposed on the first side of the product disk. The applicator engaging mechanism removably couples the applicator with the product disk.

BRIEF DESCRIPTION OF THE DRAWINGS

The above needs are at least partially met through provision of one, more than one, or any combination of the approaches for cosmetic and/or skincare sampling systems described in the following detailed description, particularly when studied in conjunction with the drawings, wherein.

Figure 1:
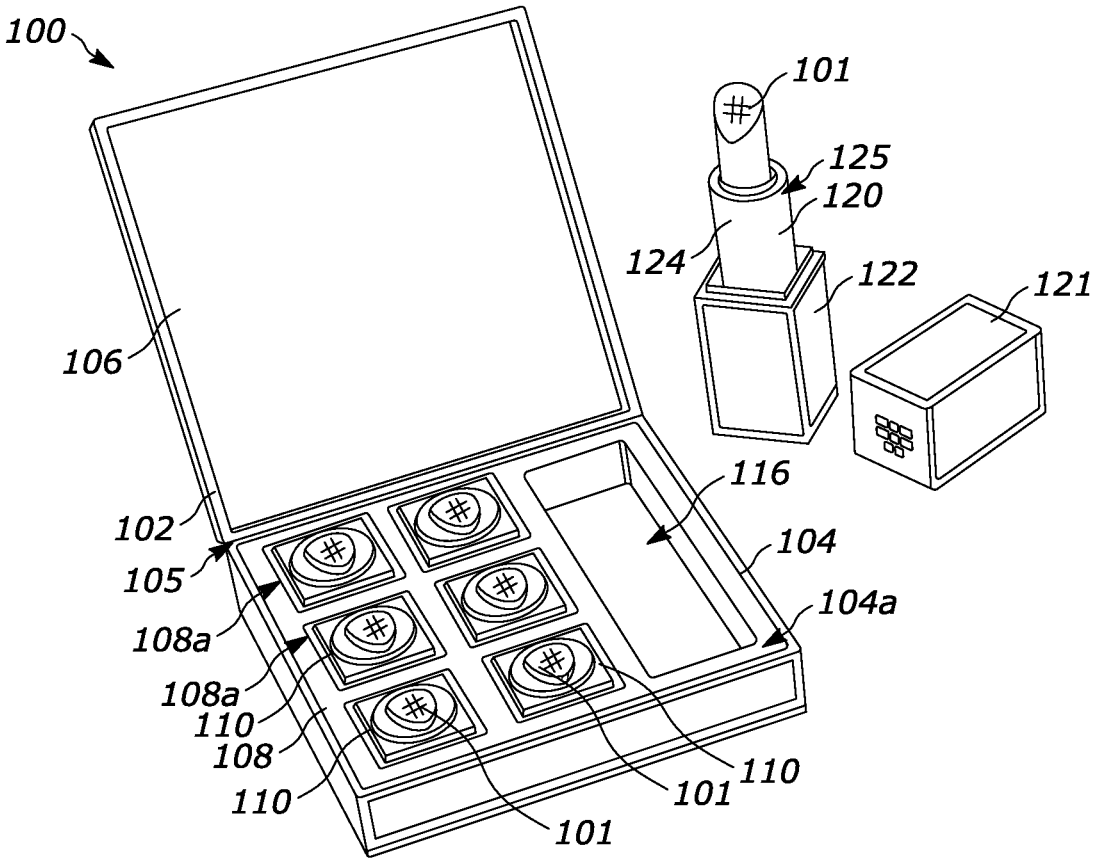
FIG. 1 illustrates a perspective view of an example sampling and/or trial system in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, a sampling and/or trial system for a product is provided having modular features. The sampling systems described herein allow for users to quickly and seamlessly replace or interchange different cosmetic and/or skincare products and applicators as desired to apply to their face and/or skin. The system may use reusable components and may reduce overall product packaging requirements. In some examples, upon a user determining which of the sample products they wish to purchase in larger (i.e., full-sized) quantities, the system may similarly accommodate such larger quantities therein.

Turning to the figures, a cosmetic and/or skincare sampling system 100 includes a cosmetic and/or skincare product 101, a container 102, an applicator 120, and any number of product disks 150. While the illustrated examples depict a lipstick product, in other examples, the product 101 may be any number or combination of different cosmetic and/or skincare products. For example, the product 101 may be in the form of a foundation, a concealer, an eyeshadow, a bronzer, a brow, a solid serum, a solid SPF product, a skincare item, a solid face balm, a lip balm, an applicator head such as a sponge, a brush, a solid blush, a solid contouring stick, an impregnated sponge or carrier capable of retaining a liquid skincare or cosmetic product, or a semi-solid skincare or cosmetic product.

The container 102 includes a base 104 having an interior cavity 104*a*, a lid 106, and a hinge 105 that rotatably couples the lid 106 with the base 104. In other examples (not illustrated) the lid 106 may be operably coupled with the base 104 via any number of suitable approaches such as, for example, a friction fit connection, a threaded connection, a magnetic connection, a vacuum or suction mechanism, and the like. Other examples are possible. The container 102 may be constructed from any number of suitable materials and/or combinations of materials such as, for example, metals, polymers, and the like. As illustrated in FIG. 1, the container 102 has a generally rectangular prismatic shape, though other suitable examples such as cylindrical are possible.

Figure 2:
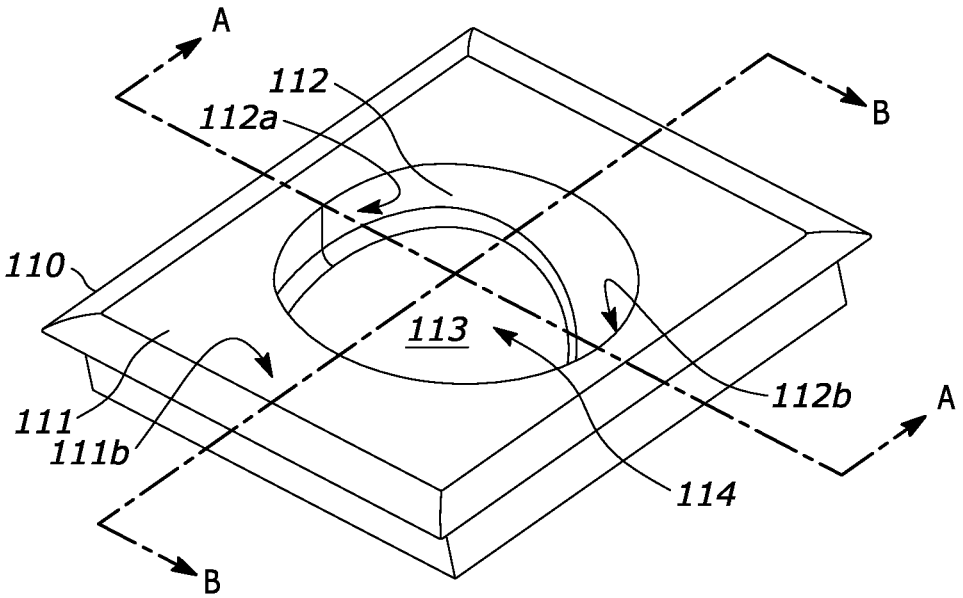
FIG. 2 illustrates a perspective view of an example tray adapted to retain a product for use with the example sampling system of FIG. 1 in accordance with various embodiments.
Figure 3:
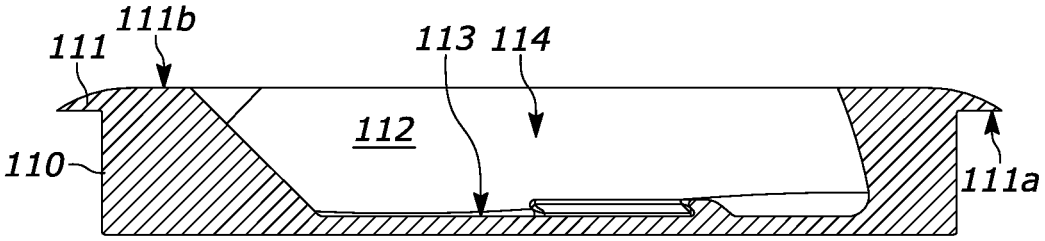
FIG. 3 illustrates a right side elevation cross-sectional view of the example tray of FIG. 2 taken along a plane A-A illustrated in FIG. 2 in accordance with various embodiments.

The container 102 further includes a divider or top plate 108 having a number of openings 108*a* (e.g., six) dimensioned to receive a corresponding number of trays 110. The divider 108 may also include an applicator opening 108*b* dimensioned to receive the applicator 120. With reference to FIGS. 2 & 3, each tray 110 includes a support ledge 111 having a lower surface 111*a* and an upper surface 111*b*, a sidewall 112 extending downwardly from the support ledge 111, and a lower surface 113. The lower surface 111*a* of the support ledge 111 is adapted to rest on (i.e., is positionable adjacent to) the divider 108 such that the remainder sidewall 112 and the lower surface 113 are at least partially disposed within is in the opening 108*a* (and thus into the interior cavity 104*a* of the base 104). In some examples, the lower surface 111*a* of the support ledge 111 (and thus the tray 110) and the divider 108 may be coupled with each other using magnets, adhesives, a friction-fit coupling, and the like. Other examples are possible.

Figure 4:
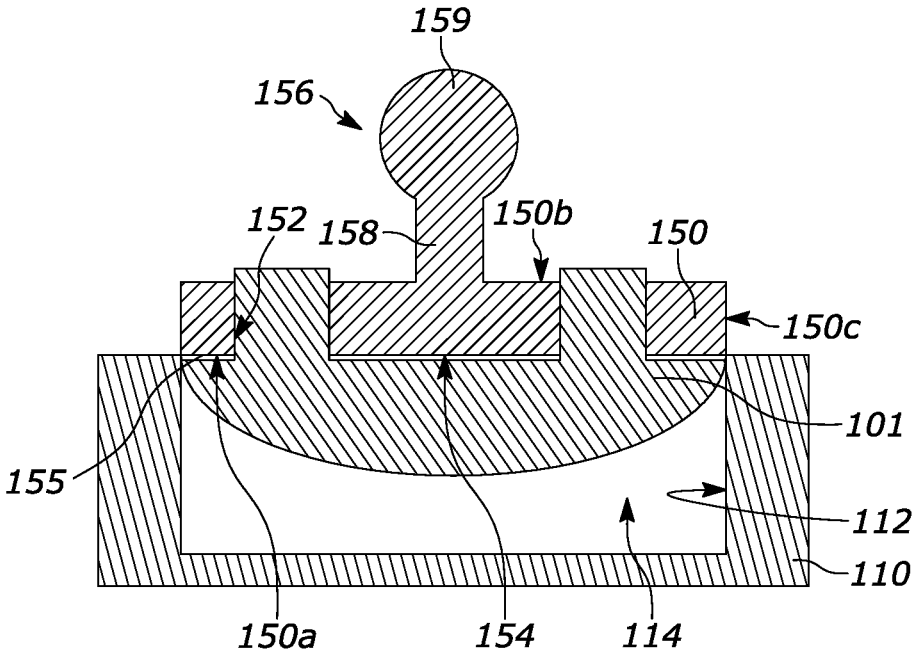
FIG. 4 illustrates a cross-sectional schematic view of an example product disk such as the disk illustrated in FIGS. 8 and 9 being positioned adjacent to the example tray of FIGS. 2 and 3 taken along the plane A-A illustrated in FIG. 2 in accordance with various embodiments.
Figure 5:
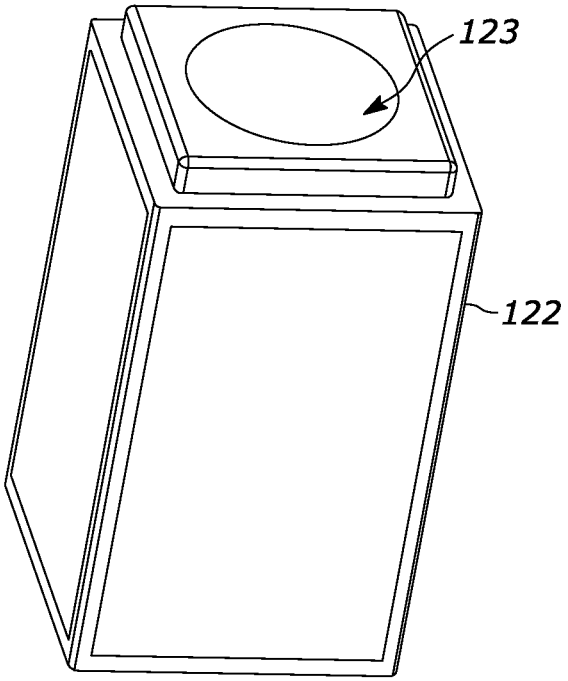
FIG. 5 illustrates a perspective view of an example applicator base for use with the example sampling system of FIGS. 1-4 in accordance with various embodiments.

As illustrated in FIGS. 3 & 4, the sidewall 112 and the lower surface 113 combine to define a cavity 114 which is dimensioned to receive and/or retain at least a portion of the product disk 150 and/or a quantity of cosmetic product 101 disposed thereon. As illustrated in FIG. 3, in some examples, the sidewall 112 may have a curved, angled and/or tapered surface relative to the lower surface 113. In these configurations, the sidewall 112 may act as a stop mechanism to retain and/or prevent the product disk 150 from advancing further in a downward direction into the cavity 114 by frictional engagement therebetween. In other examples, such a stop mechanism may be in the form of a frictional engagement, a notch, a tab, a protrusion, and the like. Other examples are possible. In yet other examples, the sidewall 112 may include a ledge region (not illustrated) to retain and/or prevent the product disk 150 from advancing further into the cavity 114.

With reference to FIGS. 5-12, the applicator 120 includes a cap 121, an applicator base 122, an applicator tube 124, and an applicator engaging mechanism 130. The applicator base 122 may be used as a handle a user grasps when applying the desired cosmetic product 101, and includes an opening 123 to receive a portion of the applicator tube 124. The applicator tube 124 includes a first end 124*a*, a second end 124*b*, a generally hollow body extending therebetween having an interior cavity 124*c* which includes an interior platform 124*d*, and an applicator retention region 126. The applicator tube 124 extends along a longitudinal axis "A". In the illustrated example, the applicator tube 124 is generally cylindrical in shape, though other configurations are possible.

The applicator retention region 126 is positioned at the first end 124*a* of the applicator tube 124 and includes a first end 126*a*, a second end 126*b*, and a ledge or countersunk region 128 dimensioned to receive and engage a portion of the product disk 150. In the illustrated example, the applicator retention region 126 is in the form of a separate member that operably couples with the applicator tube 124 via a friction-fit engagement via a slot formed on the applicator tube 124 and a corresponding protrusion formed on the first end 126*a* of the applicator retention region 126. However, other arrangements are possible including, for example, the applicator retention region 126 being integrally formed with the applicator tube 124. The applicator retention region 126 is generally hollow and defines an interior cavity 126*c*.

In the illustrated examples, the second end 126*a* of the applicator retention region 126 is obliquely angled relative to the longitudinal axis A, though other relative configurations are possible. Accordingly, in this configuration, the second end 126*a* of the applicator retention region 126 has a generally planar, ovoid shape.

The second end 124*b* of the applicator tube 124 is insertable into the opening 123 of the applicator base 122, and may be secured therewith via a number of approaches such as, for example, a threaded connection, a friction-fit connection, the use of protrusions and corresponding notches, and the like. In some examples, the applicator base 122 and the applicator tube 124 may be movably coupled with each other such that relative axial movement therebetween may be permitted. Other examples are possible. As will be discussed in further detail herein, the second end 124*b* of the applicator tube 124 further includes an opening 125.

Figure 6:
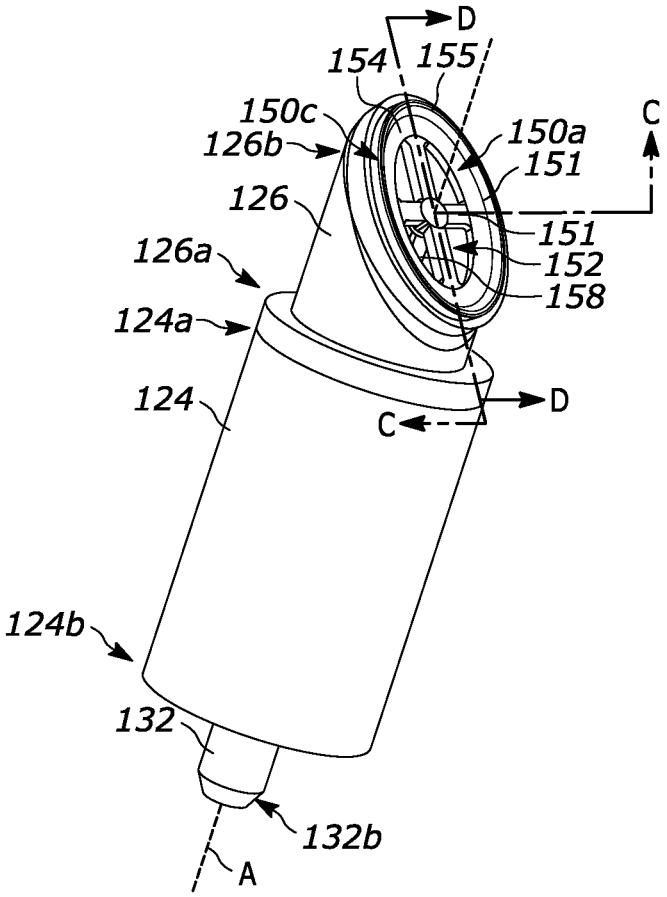
FIG. 6 illustrates a perspective view of an example applicator tube and applicator engaging mechanism for use with the example sampling system of FIGS. 1-5 in accordance with various embodiments.
Figure 7:
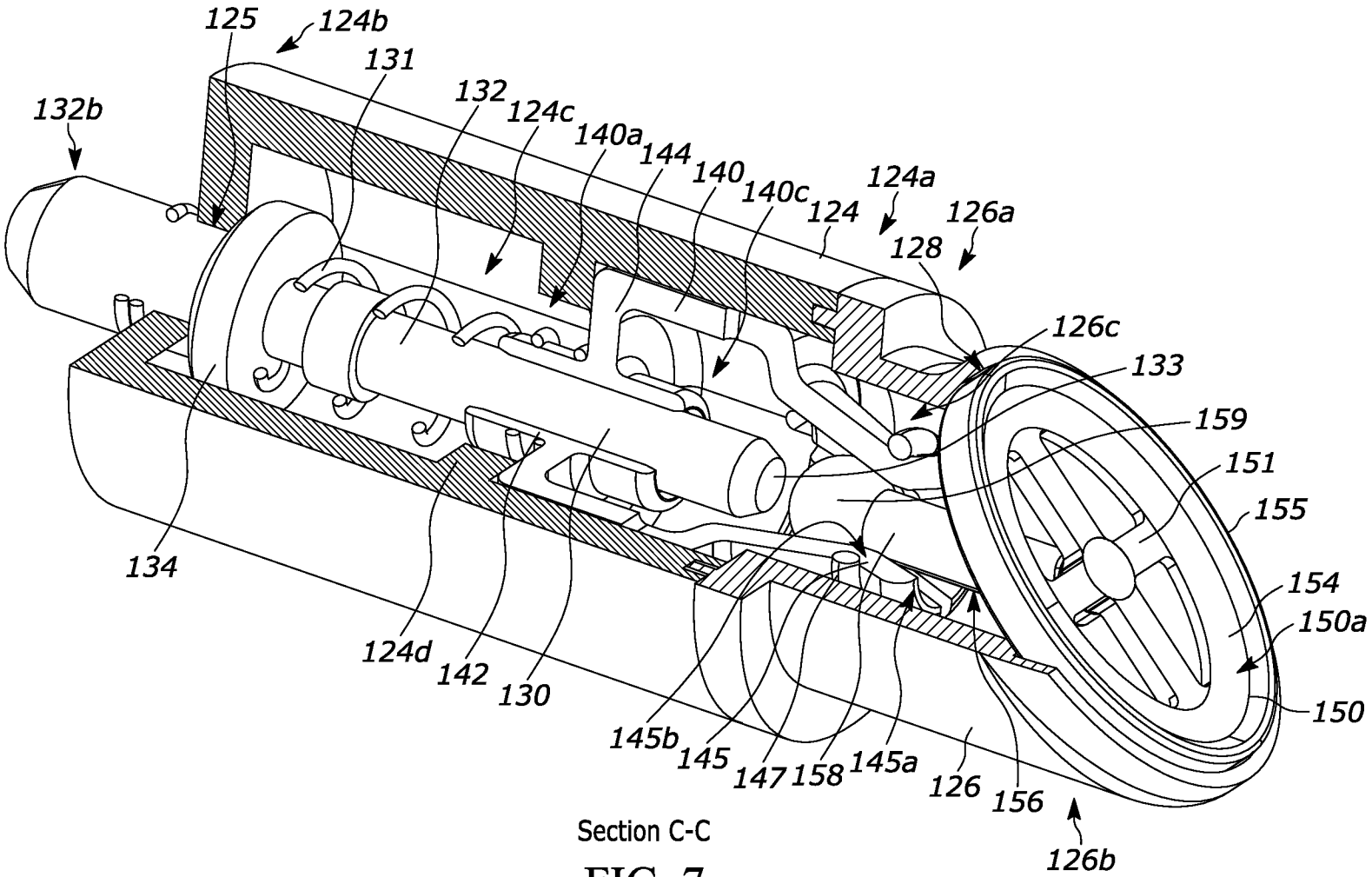
FIG. 7 illustrates a front perspective partial sectional view of the example applicator tube and applicator engaging mechanism of FIG. 6 taken along intersecting planes labeled B-B as illustrated in FIG. 6 in which a portion of the applicator tube removed for clarity in accordance with various embodiments.
Figure 8:
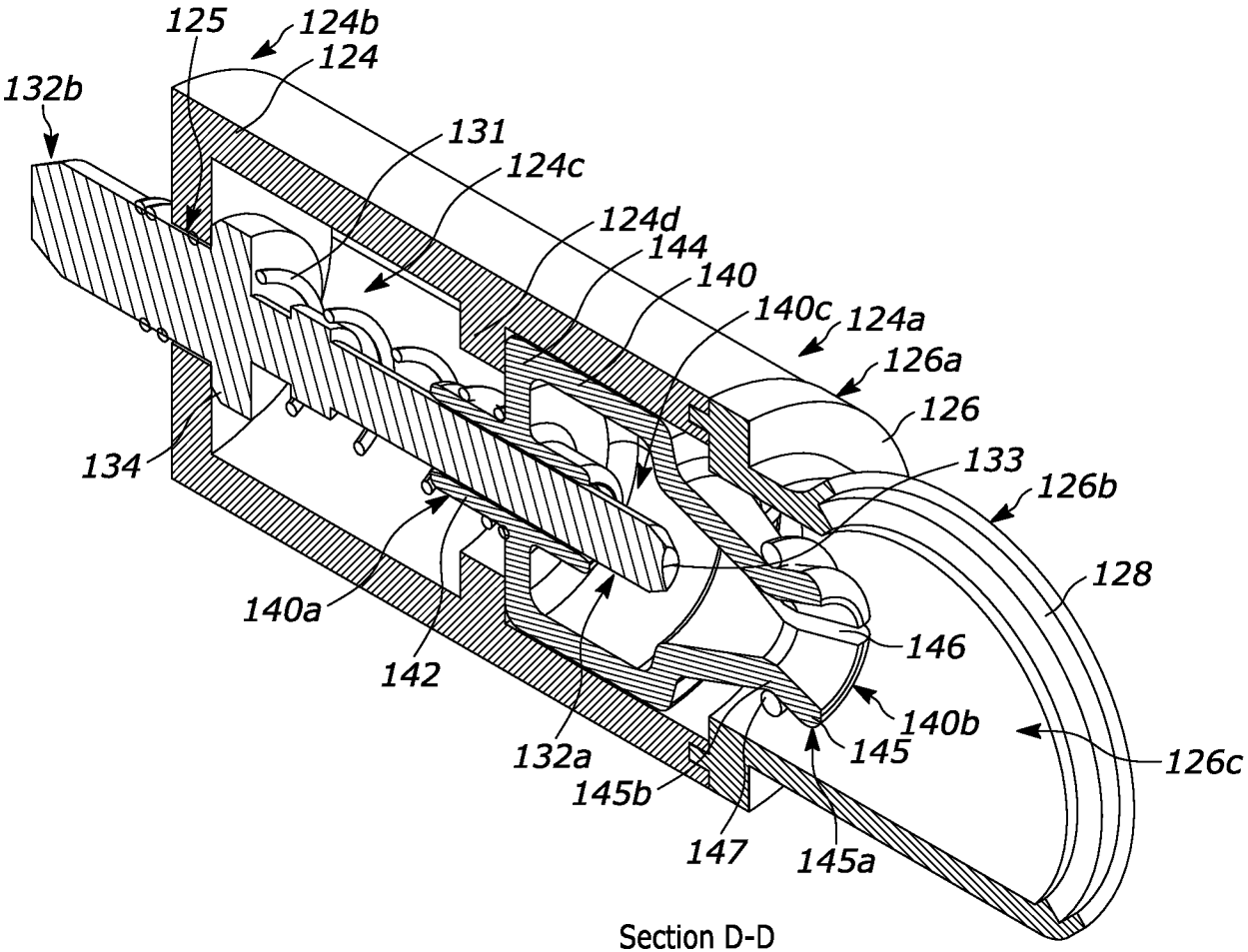
FIG. 8 illustrates a front perspective cross-sectional view of the example applicator tube of FIGS. 6 and 7 taken along the plane C-C illustrated in FIG. 6 in accordance with various embodiments.

As illustrated in FIGS. 6-8, the applicator engaging mechanism 130 is at least partially disposed within the interior cavity 124*c* of the applicator tube 124 and the interior cavity 126*c* of the applicator retention region 126. In some examples (not illustrated), a portion of the applicator engaging mechanism 130 may not extend into the interior cavity 126*c* of the applicator retention region 126. The applicator engaging mechanism 130 includes an urging member 132 and a grip member 140. The urging member 132 is in the form of a rod or elongated member having a first end 132*a* and a second end 132*b*. The first end 132*a* of the urging member 132 defines a contact surface 133. The urging member 132 further includes a flange 134 positioned near the second end 132*b* thereof. The second end 132*b* of the urging member 132 extends through the opening 125 of the applicator tube 124 to any desired length (e.g., between approximately 0.1" and approximately 5").

The grip member 140 includes a first end 140*a*, a second end 140*b*, and defines a body having an interior cavity 140*c*. The first end 140*a* of the gripping member 140 includes a port 142 positioned adjacent to a ledge 144. As illustrated in FIGS. 7 and 8, the grip member 140 is at least partially disposed within the interior cavity 124*c* of the applicator tube 124 such that the ledge 144 of the gripping member 140 is positioned adjacent to the interior platform 124*d* formed on the interior cavity 124*c* of the applicator tube 124 to restrict movement towards the second end 124*b* of the tube 124.

The second end 140*b* of the gripping member 140 includes a plurality of arms 145. In some examples, the arms 145 are constructed from a resilient material. Each of the arms 145 is separated by a slit 146. The second end 140*b* of the gripping member 140 is generally hourglass shaped, meaning two inverse tapers form an outermost wide region 145*a*, to a narrow region 145*b*, and back to a wide region as the gripping member 140 progresses towards the first end 140*a* thereof. The narrow region 145*b* defined by the arms 145 receives an elastomeric material (e.g., a band, an O-ring, etc.) 147 capable of expansion and contraction. The band 147 biases the arms 145 to a closed configuration.

The first end 132*a* of the urging member 132 extends through the port 142 of the grip member 140 and into the interior cavity 140*c* thereof. The urging member 132 is movable relative to the grip member 140 within the interior cavity 140*c*. A resilient member 131 is also disposed within the interior cavity 124*c* of the applicator tube 124 and is positioned between the flange 134 and the grip member 140 to bias the flange 134 against the second end 124*b* of the applicator tube 124. So configured, and as will be discussed in detail below, a user may press the second end 132*b* of the urging member 132 to cause the contact surface 133 thereof to advance towards the first end 124*a* of the applicator tube 124.

Figure 9:
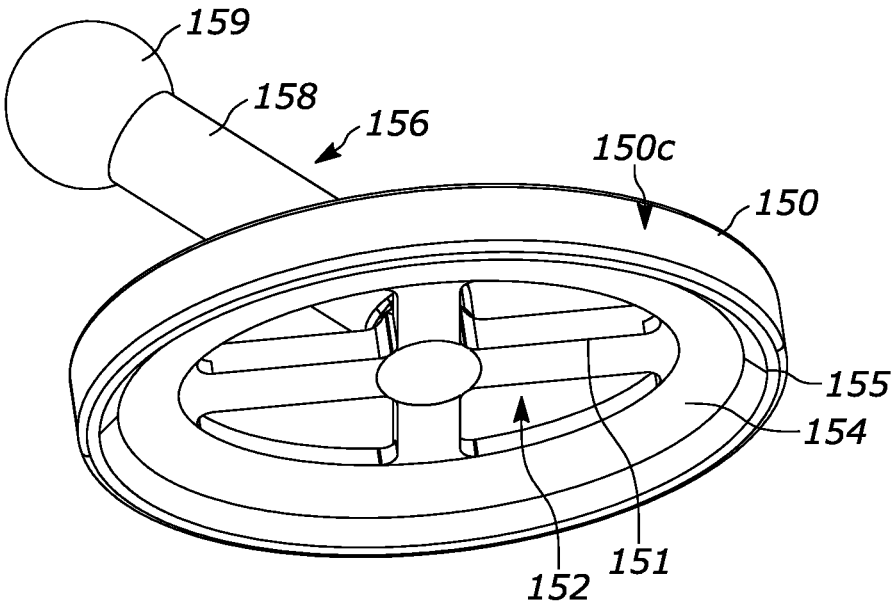
FIG. 9 illustrates a front side perspective view of a portion of the example product disk for use with the example system of FIGS. 1-8 in accordance with various embodiments.
Figure 10:
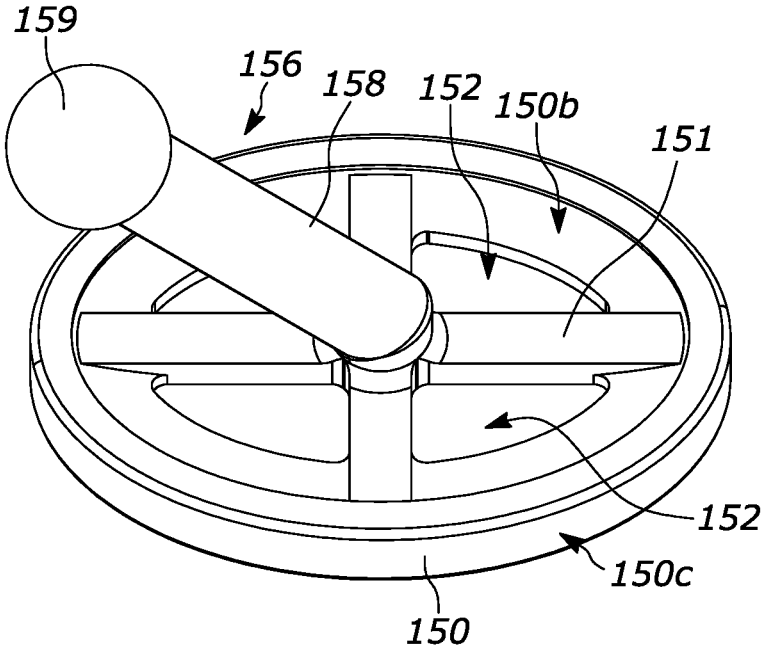
FIG. 10 illustrates a rear side perspective view of a portion of the example product disk of FIG. 9 in accordance with various embodiments.
Figure 11:
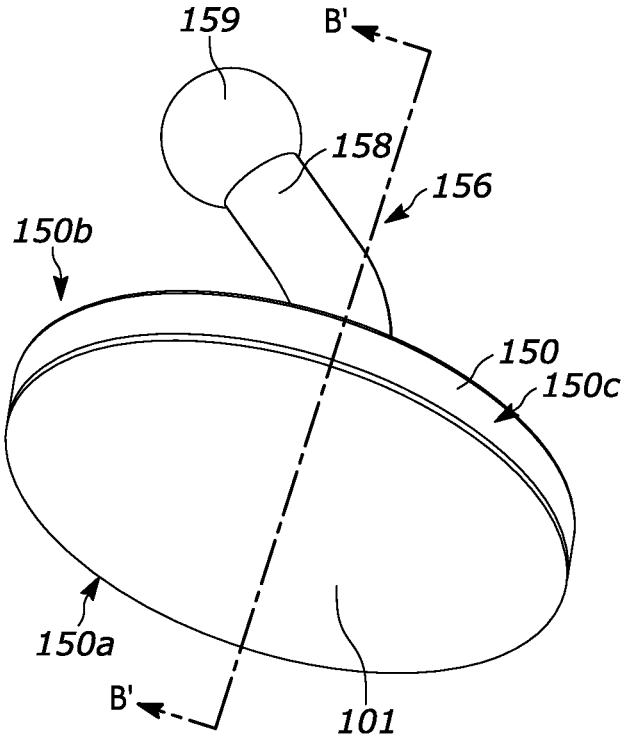
FIG. 11 illustrates a front perspective view of the example product disk of FIGS. 9 and 10 containing an example product in accordance with various embodiments.
Figure 12:
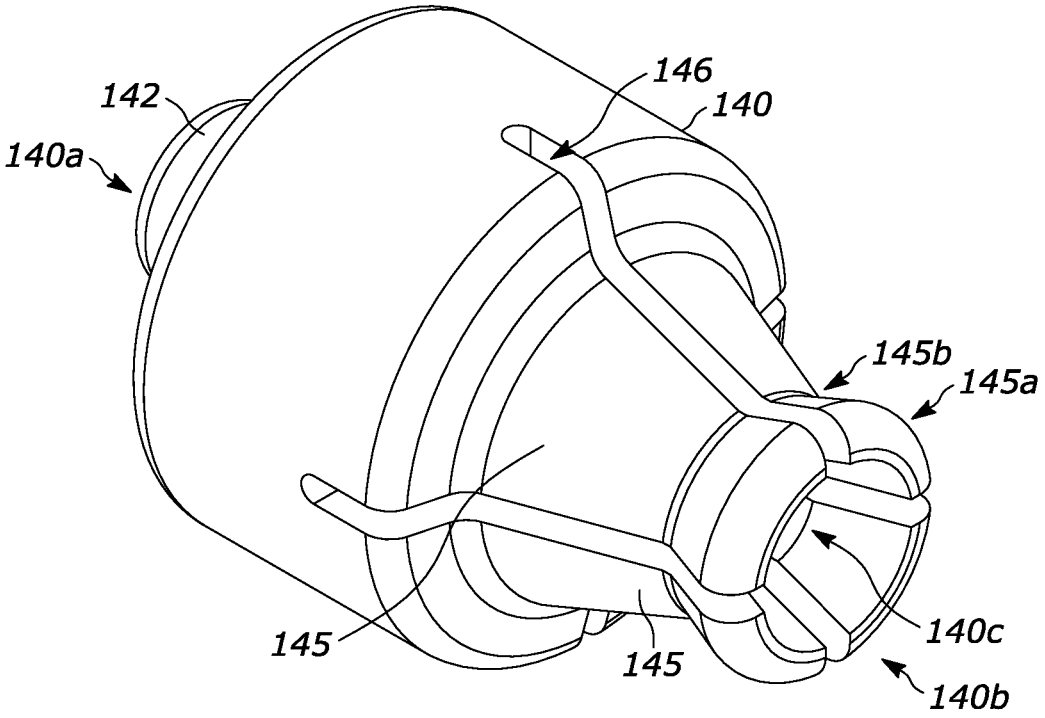
FIG. 12 illustrates a front side perspective view of an example grip member for use with the example system of FIGS. 1-11 in accordance with various embodiments.

Turning to FIGS. 9-11, the product disk 150 is in the form of a body having a first or lower side 150*a*, a second or upper side 150*b*, and an outer sidewall 150*c*. A support member or frame 151 extends through the disk 150 and defines a number of openings or throughbores 152. In the illustrated examples, each of the first and second sides 150*a*, 150*b* are generally planar as defined by the support member 151. However, other arrangements are possible. The first side 150*a* of the product disk 150 includes a product receiving surface 154 and a raised outer edge 155 positioned around a periphery of the product receiving surface 154. With reference to FIGS. 4 and 11, the product receiving surface 154 is dimensioned to receive a sample quantity of product 101 thereon. For example, the product receiving surface 154 may accommodate a quantity of lipstick sufficient for between approximately two and approximately ten applications. Other examples of suitable quantities are possible. In the illustrated example, the product 101 protrudes outwardly from the product receiving surface 154 and forms an oval shape, though other arrangements are possible depending on the desired application style and/or profile.

The second side 150*b* of the product disk 150 includes a disk coupling mechanism 156 in the form of a protrusion 158 located at a central portion of the support member 151 that extends away from the second side 150*b*. More specifically, the protrusion 158 is in the form of a rod having a ball 160 positioned at an outermost portion (i.e., positioned distally from the second end 150*b* of the product disk 150). Generally speaking, the disk coupling mechanism 156 is adapted to selectively engage the applicator retention region 126 of the applicator tube 124 as well as the applicator engaging mechanism 130.

More specifically, the ball 160 of the disk coupling mechanism 156 is dimensioned and configured to be received within the interior cavity 126*c* of the applicator retention region 126. Further, at least a portion of the outer sidewall 150*c* of the product disk 150 (i.e., the portion near the second side 150*b*) is dimensioned and configured to be received and/or nest within the ledge or countersunk region 128 of the applicator retention region 126.

Similarly, the product disk 150 is dimensioned such that it may be positioned adjacent to and/or at least partially within the cavity 114 of the tray 110. More specifically, in some arrangements, the outer sidewall 150*c* of the product disk 150 may have a dimension that is smaller than the corresponding dimension of the periphery of the cavity 114 of the tray as defined by the sidewall 112. Accordingly, at least a portion of the body of the product disk 150 (i.e., the first side 150*a*) may be positionable and/or nestable within the cavity 114 of the tray 110.

In some examples and as previously noted, the tapered configuration of the sidewall 112 may serve as a physical restriction that prevents the product disk 150 from being disposed further into the cavity 114 of the tray 110. As a result, when the product disk 150 is positioned adjacent to and/or at least partially within the cavity 114, a space or gap may be formed between the product receiving surface 154 of the product disk 150 and the lower surface 113 of the tray 110 that is sufficiently sized to retain the product 101. Accordingly, the product 101 may be safely disposed within the cavity 114 without being damaged by the sidewall 112 and/or the lower surface 113 of the tray 110. So arranged, the second side 150*b* of the product disk 150, and more specifically, the protrusion 158, may be positioned adjacent to and/or may extend upwardly from the upper surface 111*b* of the support ledge 111.

As illustrated in FIG. 4, the throughbore or throughbores 152 allow either a portion of the product 101 to be disposed therethrough and/or alternatively may operate as a window or visual indicator that allows a user to determine the appearance (e.g., the shade, color, and/or other visual characteristic) of the product 101 disposed on the product receiving surface 154 of the product disk 150 when positioned within the cavity 114 of the tray 110.

In operation, any number of product disks 150 may be removably retained within individual cavities 114 of trays 110, which in turn are disposed within respective openings 108*a* of the divider 108, which is disposed within the interior cavity 104*a* of the base 104. Each of these disks 150 may include samples of the product 101 having different visual characteristics (e.g., varying colors or shades, sheen levels (e.g., matte, satin, or sheer), and/or may have varying degrees of transfer resistance). A user may determine which product 101 sample they wish to apply by viewing the product 101 through the throughbore 152 of the product disk 150.

Upon selecting the desired product 101, the user may position the first end 124*a* of the applicator tube 124, and more specifically, the second end 126*b* of the applicator retention region 126 near the ball 159 of the product disk 150, and may move the applicator 120 towards the ball 159 such that the protrusion 158 enters the interior cavity 126*c* of the applicator retention region 126 and engages the second end 140*b* of the gripping member 140. More specifically, the ball 159 engages the outermost wide region 145*a* of the arms 145, and upon continued pressing by a user, the ball 159 will cause the arms 145 and the band 147 to expand and increase in diameter to allow the ball 159 to push beyond the narrow region 145*b* and into the remainder of the interior cavity 140*c*. As illustrated in FIG. 7, in this position, the ball 159 is disposed adjacent to or near the contact surface 133 of the urging member 132. Further, upon the ball 159 moving beyond the narrow region 145*b* of the arms 145, the band 147 will contract, thus causing the arms 145 to similarly contract to a dimension that is less than a dimension of the ball 159, thus retaining the ball 159 within the interior cavity 140*c* of the grip member 140. Further, in this configuration, the outer sidewall 150*c* of the product disk 150 is nested within the ledge 128 of the applicator retention region 126 to retain the product disk 150 within a portion of the interior cavity 126*c* thereof. A user may then lift the applicator 120 away from the tray 110, which will in turn cause the product disk 150 to be removed therefrom. The user may then apply the sample of the product 101 as desired.

So configured, the gripping member 140 and the ledge 128 retain the product disk 150 in a secure manner. In some examples, the engagement between the applicator 120 and the product disk 150 may generate a tactile feedback to alert the user that the applicator 120 and the product disk 150 are fully coupled together.

In some examples, the user may place the cap 121 onto the applicator base 122 while the product disk 150 is coupled with the applicator 120 for the purposes of storage.

The product disk 150 may be decoupled from the applicator 120 by positioning the first side 150*a* near and/or within the cavity 114 of the tray 110 and engaging (e.g., pushing) the second end 132*b* of the urging member 132 inwardly in an axial direction towards the first end 124*a* of the applicator tube 124. Such urging causes the contact surface 133 to engage and push the ball 159 against the narrow region 145*b* of the arms 145. Continued urging will cause the ball 145 to press against the narrow region 145*b* until the band 147 expands to a dimension that allows the ball 159 to pass therethrough and into the outermost wide region 145*a* of the arms 145, at which point the product disk 150 will be decoupled from the applicator engaging mechanism 130 and may drop into or near the desired cavity 114. In some examples, the sidewall 112 may include a magnet that assists with retaining the product disk 150 within the cavity 114.

In some examples, when the applicator tube 124 is coupled with the applicator base 122, the urging member 132 may be dimensioned to extend through a rearmost portion of the applicator base 122. In these arrangements, a user may press the urging member 132 as previously described to decouple the product disk 150 from the applicator 120. In other examples, the urging member 132 may be dimensioned such that a portion of the second end 132*b* is positioned near a wall defined by the opening 123 of the applicator base 122. In these examples, the user may press the applicator base 122 while holding the applicator tube 124 to cause relative movement therebetween, which in turn will cause the wall defined by the opening 123 to urge the urging member 132 forwards to decouple the product disk 150 from the applicator 120. In yet other examples, the urging member 132 may include a threaded connection that threadably engages the applicator tube 124 and/or the applicator base 122. In such an arrangement, upon twisting the applicator tube 124 and/or the applicator base 122, the urging member 132 may be advanced to urge the ball 159. Other examples are possible.

Upon selectively decoupling the product disk 150 from the applicator 120, a user may couple a different product disk 150 therewith to apply the desired product 101 or may return the applicator to the applicator cavity 116 as desired. So configured, a user may quickly selectively sample any number of varying cosmetic and/or skincare products 101 to determine a desired product for subsequent purchase. In some examples, the applicator tube 124 may be dimensioned to accommodate a full-sized quantity of product 101 to allow for the use of the same applicator 120 used to sample varying products 101. In such examples, the applicator tube 124 may include an advance/retract mechanism. In other examples, the applicator tube 124 may be removed from the base 122 when the user determines which full-sized product they wish to purchase, and a replacement applicator (not illustrated) may be inserted into the base 122 that includes a full-sized quantity of product 101. In some examples, the product disks 150 may be reused and/or recycled upon returning them to the manufacturer, thereby potentially reducing overall component and manufacturing costs.

Figure 13:
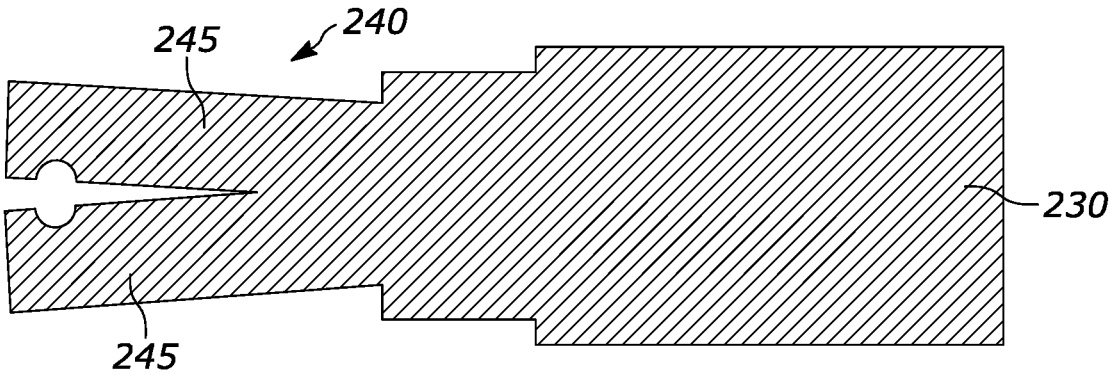
FIG. 13 illustrates a schematic sectional view of an alternative example applicator engaging mechanism taken along a central plane thereof for use with the example system of FIGS. 1-12 in accordance with various embodiments.

It will be appreciated that any number of modifications may be made to the system 100. For example, FIG. 13 illustrates an alternative applicator engaging mechanism 230 that includes a grip member 240 having normally outwardly-biased or splayed arms 245. In such an arrangement, the applicator retention region (not illustrated) may include a closure opening having a diameter sufficiently small enough to cause the arms 245 to be retained in a closed configuration to secure the product disk. As such, the arms may be prevented from opening when disposed within the cavity of the actuator. Upon advancing the engaging mechanism 230 beyond this closure opening, the arms 245 may splay outwardly to release the product disk.

Further, in some examples, each of the applicator coupling mechanism 126 and the disk coupling mechanism 156 may have opposite configurations whereby the applicator is inserted into a portion of the product disk. Other arrangements are possible.

In the foregoing specification, specific examples have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described examples/implementations should not be interpreted as mutually exclusive, and should instead be understood as potentially combinable if such combinations are permissive in any way. In other words, any feature disclosed in any of the aforementioned examples/implementations may be included in any of the other aforementioned examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A system for products comprising:

a container defining at least one disk cavity having a lower surface;

a product disk having a first side, the first side having a product receiving surface, a second side, a body including an outer sidewall extending therebetween, and a protrusion extending beyond the second side of the product disk, at least a portion of the first side of the product disk adapted to be selectively positionable adjacent to the at least one disk cavity;

a cosmetic and/or skincare product being at least partially disposed on the product receiving surface of the first side of the product disk;

an applicator having a first end and an applicator interior cavity, the first end including an applicator retention region, at least a portion of the second side of the product disk being positionable adjacent to the applicator retention region, the applicator retention region including a countersunk region, the outer sidewall of the body of the product disk dimensioned to nest within the countersunk region; and an applicator engaging mechanism operably coupled with the applicator, wherein the applicator engaging mechanism includes a grip member disposed within the applicator interior cavity, wherein the grip member includes a grip member interior cavity and a plurality of arms positionable in: 1) an open configuration in which the protrusion is selectively insertable within the grip member interior cavity; and 2) a closed configuration whereby the plurality of arms prevent the protrusion from being removed from the grip member interior cavity, the plurality of arms being biased to the closed configuration;

wherein the product disk is adapted to be removably coupled with the at least one disk cavity of the container such that a gap is formed between the product receiving surface and the lower surface of the disk cavity to retain the cosmetic and/or skincare product, and the product disk is adapted to be removably coupled with the applicator engaging mechanism by grasping, using the grip member, the protrusion to selectively couple the product disk with the applicator.

2. The system of claim 1, wherein the plurality of arms are constructed from a resilient material.

3. The system of claim 2, wherein the applicator engaging mechanism further includes an urging member adapted to move towards the first end of the applicator and urge the protrusion, thereby releasing the product disk from the first end of the applicator.

4. The system of claim 1, wherein the container further defines an applicator storage cavity adapted to retain at least a portion of the applicator.

5. The system of claim 1, wherein the cosmetic and/or skincare product includes at least one of a lipstick, a foundation, a concealer, an eyeshadow, a bronzer, a brow, a solid serum, a solid spf product, a solid face balm, a lip balm, an applicator head, a brush, a solid blush, a solid contouring stick, an impregnated sponge or carrier, or a semi-solid product.

6. The system of claim 1, further including a visual indicator defined by the body of the product disk, the visual indicator adapted to allow identification of the cosmetic and/or skincare product when the product disk is positioned adjacent to the at least one disk cavity.

7. The system of claim 1, wherein the container includes a second disk cavity, the system further including a second cosmetic and/or skincare product being at least partially disposed on a second product disk, the second cosmetic and/or skincare product having a different visual characteristic than a visual characteristic of the cosmetic and/or skincare product.

8. The system for products of claim 1, the first side of the product disk further comprising a raised outer edge positioned around a periphery of the product receiving surface.

9. The system for products of claim 1, wherein the product disk is adapted to be removably coupled with the at least one disk cavity of the container such the cosmetic and/or skincare product is positioned within the at least one disk cavity with the protrusion of the product disk outside the at least one disk cavity.

10. The system for products of claim 1, wherein the at least one disk cavity further comprises a sidewall that defines the at least one disk cavity with the lower surface, the sidewall configured to limit how far the product disk can advance in a direction toward the at least one disk cavity.

11. A reusable product system comprising:

an applicator having a first end, the first end including an applicator retention region, the applicator retention region including a countersunk region;

an applicator engaging mechanism operably coupled with the applicator, the applicator engaging mechanism including a grip member disposed within an applicator interior cavity of the applicator, wherein the grip member includes a grip member interior cavity and a plurality of arms positionable in an open configuration and a closed configuration, the plurality of arms being biased to the closed configuration by an elastomeric material, the elastomeric material being in a contracted state when the plurality of arms are in the closed configuration and the elastomeric material being in an expanded state when the plurality of arms are in the open configuration;

a product disk having a first side, a second side, a body including an outer sidewall extending therebetween, the outer sidewall dimensioned to nest within the countersunk region of the applicator, and a protrusion extending beyond the second side of the product disk, at least a portion of the second side of the product disk being positionable adjacent to the applicator retention region; and a cosmetic and/or skincare product being at least partially disposed on the first side of the product disk;

wherein when the plurality of arms of the grip member are positioned in the open configuration, the protrusion is selectively insertable within the grip member interior cavity, and when the plurality of arms of the grip member are positioned in the closed configuration, the plurality of arms prevent the protrusion from being removed from the grip member interior cavity;

wherein the applicator engaging mechanism is adapted to removably couple the applicator with the product disk, wherein the grip member is adapted to grasp the protrusion to removably couple the product disk with the applicator.

12. The reusable product system of claim 11, wherein the applicator engaging mechanism includes an urging member adapted to contact the protrusion to remove the product disk from the applicator retention region.

13. The reusable product system of claim 12, wherein the urging member is separate from and moves relative to the grip member to contact the protrusion.

14. The reusable product system of claim 11, further comprising a visual indicator defined by the body of the product disk, the visual indicator adapted to allow identification of the cosmetic product when the product disk is not coupled with the applicator.

15. The reusable product system of claim 11, wherein the cosmetic and/or skincare product includes at least one of a lipstick, a foundation, a concealer, an eyeshadow, a bronzer, a brow, a solid serum, a solid spf product, a solid face balm, a lip balm, an applicator head, a brush, a solid blush, a solid contouring stick, an impregnated sponge or carrier, or a semi-solid product.

16. The reusable product system of claim 11, wherein the plurality of arms are biased to the closed configuration by a band comprising the elastomeric material, the band having a diameter that is greater in the expanded state than in the contracted state.

17. The reusable product system of claim 16, wherein an end of the grip member tapers from a first wide region to a narrow region defined by the plurality of arms and then inversely tapers to a second wide region, and the band is separate from the grip member and positioned around the narrow region.

18. A reusable product system comprising:

an applicator having a first end including an applicator retention region, the applicator retention region including a countersunk region, the applicator extending along a longitudinal axis;

an applicator engaging mechanism operably coupled with the applicator, the applicator engaging mechanism including a grip member disposed within an applicator interior cavity of the applicator and a separate urging member configured to move relative to the grip member, wherein the grip member includes grip member interior cavity and a plurality of arms extending along the longitudinal axis of the applicator, the plurality of arms positionable in an open configuration and a closed configuration, wherein the plurality of arms are relatively closer to the longitudinal axis in the closed configuration than the open configuration, the plurality of arms being biased to the closed configuration;

a product disk having a first side, a second side, a body including an outer sidewall extending therebetween, the outer sidewall dimensioned to nest within the countersunk region of the applicator, and a protrusion extending beyond the second side of the product disk and including a ball, at least a portion of the second side of the product disk being positionable adjacent to the applicator retention region; and a cosmetic product being at least partially disposed on the first side of the product disk;

wherein the applicator engaging mechanism is adapted to:

couple the product disk with the applicator by grasping the protrusion with the plurality of arms of the grip member such that the protrusion is at least partially disposed within the grip member interior cavity; and release the product disk from the applicator by moving the urging member relative to the grip member along the longitudinal axis of the applicator towards the first end of the applicator to contact the ball of the protrusion, thereby urging the protrusion of the disk from the plurality of arms of the grip member via contact between the urging member and the ball.

19. The reusable product system of claim 18 wherein the plurality of arms are biased to the closed configuration by an elastomeric material, the elastomeric material being in a contracted state when the plurality of arms are in the closed configuration and the elastomeric material being in an expanded state when the plurality of arms are in the open configuration.

20. The reusable product system of claim 19, wherein the plurality of arms are biased to the closed configuration by a band comprising the elastomeric material, the band being separate from the grip member and positioned around the grip member.

* * * * *